US005735293A

United States Patent [19]

Coniglio et al.

[11] Patent Number: 5,735,293

[45] Date of Patent: Apr. 7, 1998

[54] APPARATUS FOR HEATING ADHESIVE-CONTAINING SEAMS OF TUBULAR WRAPPERS FOR MATERIALS OF THE TOBACCO PROCESSING INDUSTRY

[75] Inventors: Antoine Coniglio, Lyons; Peter Sandkamp, Verrieres-le-Buisson; Robert Calvairac, Lisses, all of France

[73] Assignees: Decouflé s.a.r.l., Chilly-Mazarin, France; RICA, Vittorio Veneto, Italy

[21] Appl. No.: 546,871

[22] Filed: Oct. 23, 1995

[30] Foreign Application Priority Data

Oct. 21, 1994 [DE] Germany ..... 44 37 631.6

[51] Int. Cl.[6] ..... A24C 5/26

[52] U.S. Cl. ..... 131/68; 67/69; 67/84.1

[58] Field of Search ..... 131/67, 68, 69, 131/84.1; 493/41, 43, 274, 4, 8

[56] References Cited

U.S. PATENT DOCUMENTS

| | | | |
|---|---|---|---|
| 1,885,969 | 11/1932 | Werner . | |
| 3,507,288 | 4/1970 | Korber | 131/68 |
| 4,480,644 | 11/1984 | Luke | 131/68 |
| 5,124,559 | 6/1992 | Zertani et al. | 250/492.1 |
| 5,345,950 | 9/1994 | Adebahr et al. | 131/69 |

FOREIGN PATENT DOCUMENTS

| | | | |
|---|---|---|---|
| 369205 | 1/1907 | France | 131/68 |
| 610 352 | 9/1926 | France | 131/68 |
| 2 120 842 | 8/1972 | France | 131/68 |

*Primary Examiner*—V. Millin
*Assistant Examiner*—Charles W. Anderson
*Attorney, Agent, or Firm*—Darby & Darby

[57] ABSTRACT

An apparatus for heating the seam consisting of an adhesive layer between the longitudinally extending overlapping marginal portions of a running tubular wrapper for tobacco or tobacco filter material has an adjustable elongated infrared heater disposed at a level above and extending in parallel with the path for the wrapper, and a heatable heat transfer member which contacts the seam of the running wrapper. A mirror surrounds the infrared heater and reflects radiant energy toward the heat transfer member. The heater is adjustable in dependency upon the temperature of the seam and/or in dependency upon the speed of the wrapper.

15 Claims, 2 Drawing Sheets

APPARATUS FOR HEATING ADHESIVE-CONTAINING SEAMS OF TUBULAR WRAPPERS FOR MATERIALS OF THE TOBACCO PROCESSING INDUSTRY

BACKGROUND OF THE INVENTION

The invention relates to improvements in apparatus for conditioning adhesive-containing longitudinally extending seams including the longitudinally extending overlapping marginal portions of tubular wrappers for the confinement of particles of natural, artificial or substitute tobacco or filter material for tobacco smoke. More particularly, the invention relates to improvements in apparatus for heating the adhesive-containing seams of running tubular wrappers for tobacco or other particulate material of the tobacco processing industry for the purpose of achieving rapid and predictable setting of adhesive.

The making of cigarettes, cigarillos, cigars and filters for tobacco smoke in so-called rod making machines normally involves the draping of a web of cigarette paper, tipping paper, filter paper or other suitable wrapping material around a running rod-like filler consisting of or containing a particulate material of the tobacco processing industry. The marginal portions of the thus obtained tubular envelope for the filler of particulate material are caused to overlap each other to confine and to form with a layer of suitable adhesive a seam extending in parallel with the thus obtained continuous rod. The seam must be sufficiently stable to permit predictable subdivision of the rod into plain cigarettes, cigarillos, cheroots or filter rod sections of unit length or multiple unit length. Moreover, the stabilizing of the seam must be carried out at the rate at which the rod is caused to advance lengthwise in a machine which is designed to turn out at least 10,000 but often well in excess of 10,000 rod-shaped articles per minute. Stabilizing of the seam normally involves changing the temperature of the adhesive between the overlapping marginal portions of the tubular envelope for the filler of particulate material.

The adhesive can be a water-containing substance such as a starch of pasty consistency, liquid-dispersed particles of polyvinyl acetate or gelatin; such adhesives are often used on tubular envelopes consisting of cigarette paper. A thin film of adhesive is applied to one side of one of the two marginal portions of the web of wrapping material, the adhesive-coated one side of the one marginal portion is caused to overlie the exposed side of the other marginal portion, and the thus obtained seam is thereupon heated to bring about rapid setting of the adhesive film and reliable adherence of the overlapping marginal portions to each other.

On the other hand, the marginal portions of webs of filter paper which is used to confine rod-like fillers of filter material for tobacco smoke are normally bonded to each other by a hot melt which must be cooled in order to set and to thus ensure predictable adherence of the overlapping marginal portions to each other. As a rule, the film of hot melt (also called hotmelt) is heated and thus activated prior to cooling.

An apparatus which is presently in use for the application of adhesive to cigarette paper and for heating the thus obtained seam in order to ensure rapid setting of the adhesive film between the overlapping marginal portions of the tubular envelope is disclosed, for example, in U.S. Pat. No. 3,507,288. The disclosure of this patent is incorporated herein by reference. An apparatus for the application, subsequent heating (activation) and subsequent cooling (setting) of hot melt between overlapping marginal portions of a tubular envelope consisting of filter paper is disclosed, for example, in published French patent application No. A 2 120 842 to which reference may be had, if necessary.

The means for heating the adhesive in a seam including the overlapping marginal portions of a tubular envelope of cigarette paper normally comprises a sealer in the form of an elongated strip which is heated by a cartridge-like heating device. The strip is in direct contact with the seam of the tubular envelope which is advanced lengthwise at an elevated speed toward the so-called cutoff which divides the continuous tobacco-containing rod into sections of unit length or multiple unit length. The operation of such apparatus is satisfactory when the strip-shaped sealer is maintained at a given temperature which is necessary to ensure rapid setting of successive increments of adhesive advancing past the heating station. However, the heating of such sealer to operational temperature takes up a certain interval of time during which the rod making machine cannot turn out satisfactory rod-shaped articles. Since a heating from room temperature to operational temperature of the sealer must take place practically after each and every stoppage of the rod making machine, the total period of idleness is relatively long so that it can appreciably affect the output of such machines.

Additional problems arise when the speed of advancement of the seam is changed, particularly when the speed is reduced, because this necessitates a reduction of the temperature of the sealer in order to avoid overheating and resultant charring of the marginal portion or portions forming part of the running seam. The situation is aggravated due to the fact that, as a rule, the heat storing capacity of the sealer as well as the cartridge-like heater is quite pronounced. In other words, the thermal inertia of such parts does not permit rapid changes of the temperature of that portion of the sealer which contacts the running seam which, in turn, brings about the danger of damage to those portions of the seam which advance past the sealer while the temperature of the sealer is being lowered due to a reduction of the speed of longitudinal movement of the seam past the sealer. The situation is analogous in connection with the activating devices for hot melt in the seams of tubular envelopes containing filter paper.

OBJECTS OF THE INVENTION

An object of the invention is to provide an apparatus which can rapidly change the temperature of the means for heating the seams including films of adhesive between longitudinally extending marginal portions of tubular envelopes for particulate materials of the tobacco processing industry.

Another object of the invention is to provide the above outlined apparatus with novel and improved means for directly contacting a running seam.

A further object of the invention is to provide a versatile apparatus which can rapidly change the temperature at the seam of a running tubular envelope for tobacco particles or particles of filter material.

An additional object of the invention is to provide a novel and improved method of heating the seams of running tubular envelopes in rod making machines of the tobacco processing industry.

Still another object of the invention is to provide a rod making machine for cigarettes, cigars, cigarillos, cheroots or filter rod sections which embodies one or more apparatus of the above outlined character.

Another object of the invention is to provide a novel and improved source of heat for use in the above outlined apparatus.

A further object of the invention is to provide an apparatus which can be installed in existing rod making machines as a superior substitute for heretofore known and used seam heating apparatus.

An additional object of the invention is to provide the above outlined apparatus with novel and improved means for directing heat from a source toward the running seam.

SUMMARY OF THE INVENTION

The invention resides in the provision of an apparatus for conditioning an adhesive-containing longitudinally extending seam of a tubular wrapper confining particulate material of the tobacco processing industry and advancing longitudinally along an elongated path. The improved apparatus comprises a source of radiant energy (e.g., an elongated infrared radiator which is at least substantially parallel to the path for the wrapper and its seam) which is spaced apart from the path, and means for directly or indirectly heating the seam in a portion of the path with radiant energy issuing from the source.

The means for heating can comprise a heat transfer member which is exposed to the radiant energy and has a surface contacting the seam in the aforementioned portion of the path. The heat transfer member can contain a metallic material (e.g., aluminum) and is preferably resistant to wear (e.g., as a result of anodizing) at least in the region of its seam-contacting surface.

Alternatively, the means for heating can comprise a guide which is permeable to (i.e., which permits passage of) radiant energy and has a surface contacting the seam in the aforementioned portion of the path.

The means for heating can further comprise means for directing radiant energy from the source toward the seam in the aforementioned portion of the path, preferably by way of the heat transfer member or by way of the guide. The source can be installed at a level above the aforementioned portion of the path and the means for directing radiant energy can comprise at least one mirror which is positioned to reflect radiant energy from the source toward the aforementioned portion of the path. In accordance with a presently preferred embodiment, the mirror has a substantially elliptical cross section with a focus at least close to the source of radiant energy.

The source of radiant energy is or can be adjustable and the apparatus can further comprise means for monitoring the temperature at the aforementioned portion of the path and means for adjusting the source to change the amount of radiant energy issuing from the source as a function of departures of monitored temperature from a (fixed or variable) predetermined value. The means for monitoring can comprise means for ascertaining the temperature of the means for heating the seam.

If the wrapper and its seam can be advanced at a plurality of different speeds, the means for adjusting the source can be designed to adjust the source as a function of variations of the speed of the seam. For example, the means for adjusting the source of radiant energy can comprise a variable amplifier, e.g., a current or voltage amplifier.

The path is or can be at least substantially horizontal and the seam advancing along the elongated path can be oriented to face upwardly. As already stated hereinbefore, the source of radiant energy can be disposed at a level above the path for the tubular wrapper, and the means for heating is or can be disposed at a level between the seam in the aforementioned portion of the path and the source.

The means for heating can comprise a housing or enclosure which spacedly surrounds the source and the internal surface of which can constitute or which can carry the aforementioned mirror.

The novel features which are considered as characteristic of the invention are set forth in particular in the appended claims. The improved apparatus itself, however, both as to its construction features and advantages thereof, will be best understood upon perusal of the following detailed description of certain presently preferred specific embodiments with reference to the accompanying drawings.

DESCRIPTION OF PREFERRED EMBODIMENTS

Figure 1:
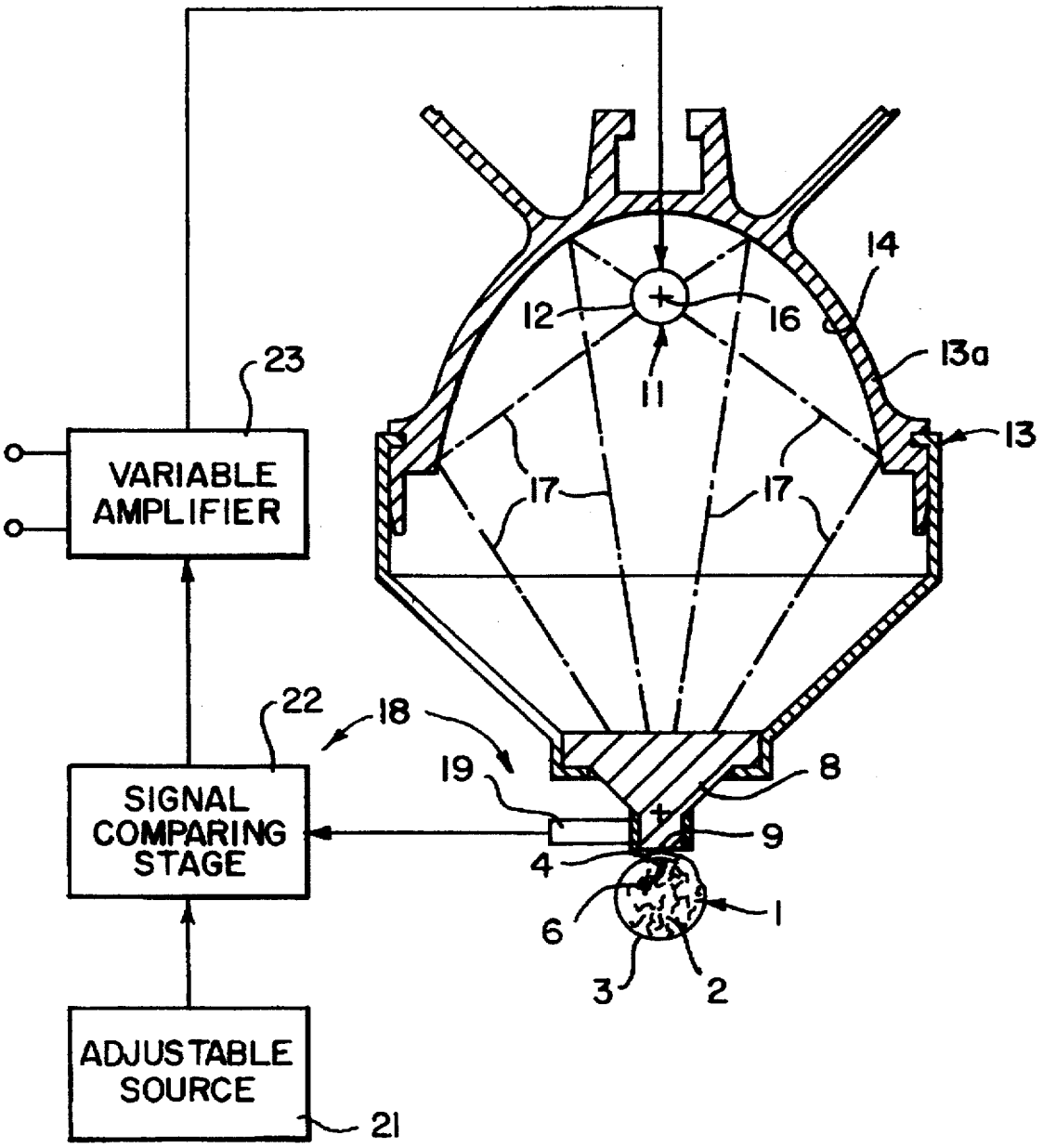
FIG. 1 is a partly diagrammatic and partly transverse sectional view of an apparatus which embodies one form of the invention and employs an adjustable infrared radiator as a source of radiant energy.

Referring to the single Figure of the drawings, there is shown an elongated at least substantially cylindrical rod 1 which is assumed to be advanced at right angles to the plane of the drawings. The rod 1 comprises a tubular envelope or wrapper 3 for a rod-like filler 2 of natural, artificial or reconstituted tobacco or filter material for tobacco smoke. If the filler 2 contains particles of tobacco, the envelope or wrapper 3 (hereinafter called wrapper) can consist of cigarette paper.

A longitudinally extending seam 7 of the wrapper 3 includes a relatively narrow strip of wrapping material along the outer marginal portion 4, a relatively narrow strip of wrapping material adjacent the other marginal portion 6 (which is overlapped by the strip adjacent the marginal portion 4), and a film of adhesive (e.g., an aqueous dispersion of gelatin, starch or polyvinyl acetate) between the two strips. The manner of forming the seam, including the application of the film of adhesive, is or can be the same as disclosed in the aforementioned U.S. Pat. No. 3,507,288. This patent discloses a conventional mode of and conventional means for heating the seam while the same advances along its path. If the filler 2 consists of or contains filter material for tobacco smoke, the wrapper can be made of filter paper and the adhesive film in the seam 7 can consist of hot melt. The manner of heating a seam which contains hot melt is or can be the same as disclosed in the aforementioned published French patent application No. A 2 120 842.

In order to cause successive increments of the adhesive film in the seam to set within short or extremely short intervals of time, it is necessary to subject the seam 7 to an intensive heating action. The apparatus which is shown in the Figure comprises an adjustable source 11 of radiant energy (note the beams 17 of infrared radiation) and means for indirectly heating the seam in that portion of the path for the seam 7 which is actually shown in the Figure. The means for indirectly heating comprises a heat transfer member 8 which is installed in the lower portion of a housing or enclosure 13 and has a surface 9 in direct contact with the material of the wrapper 3 immediately adjacent the outer marginal portion 4. The heat transfer member 8 can be made of any one of a variety of suitable heat transmitting materials, such as aluminum, and that portion of the member 8 which is immediately adjacent the surface 9 is preferably hardened so that it can stand extensive wear. This ensures that the member 8 need not be replaced at frequent intervals. If the member 8 is made of aluminum, that portion thereof which is adjacent the seam-contacting surface 9 can be hardened by resorting to a suitable anodizing treatment.

The member 8 is fixedly installed in a housing or enclosure 13 which spacedly surrounds the source 11, and this member is disposed at a level above the running seam 7 and below the source 11. The latter can include or constitute an elongated infrared radiator 12 which, as already mentioned above, is or can be at least substantially parallel to the elongated path for the rod 1, i.e., for the wrapper 3 and its seam 7. For example, the radiator 12 can be an infrared heater known as IRK Type K distributed by PHILIPS having a place of business at F-54750 Point-a-Mousson, France.

The upper portion 13*a* of the housing 13 is mirrored, as at 14. The illustrated cross section of the mirror 14 constitutes a portion of an ellipse with the focus 16 located at the center of the radiator 12. The beams 17 of radiation issuing from the radiator 12 can impinge upon the member 8 either directly or as a result of reflection by the mirror 14. This results in surprisingly quick heating of the member 8 (and hence of the running seam 7) to the desired temperature. Thus, any changes of the heating action of the radiator 12 immediately result in corresponding changes of the heating action upon the seam 7. This results in a substantial shortening of the intervals of idleness of the rod making machine which embodies the improved apparatus.

The source 11 is adjustable and, therefore, the apparatus further comprises a regulating circuit 18 which can influence the heating action upon the running seam 7 as a function of one or more variable parameters. The Figure shows that the circuit 18 comprises a device 19 which monitors the temperature of the member 8 at the surface 9 and transmits signals to a signal comparing stage 22 wherein such signals are compared with reference signals furnished by an adjustable source 21 of reference signals. If the intensity or another characteristic of signals transmitted by the monitoring device 19 departs from the corresponding characteristic of reference signals furnished by the source 21, the stage 22 transmits appropriate signals to a variable amplifier 23 which connects the radiator 12 with a suitable source of electrical energy. The arrangement is or can be such that the circuit 18 prevents any, or any appreciable, fluctuations of temperature at the surface 9 of the heat transfer member 8. The source 11 is designed to ensure that the intensity of radiation (17) can be regulated within the required range.

Figure 2:
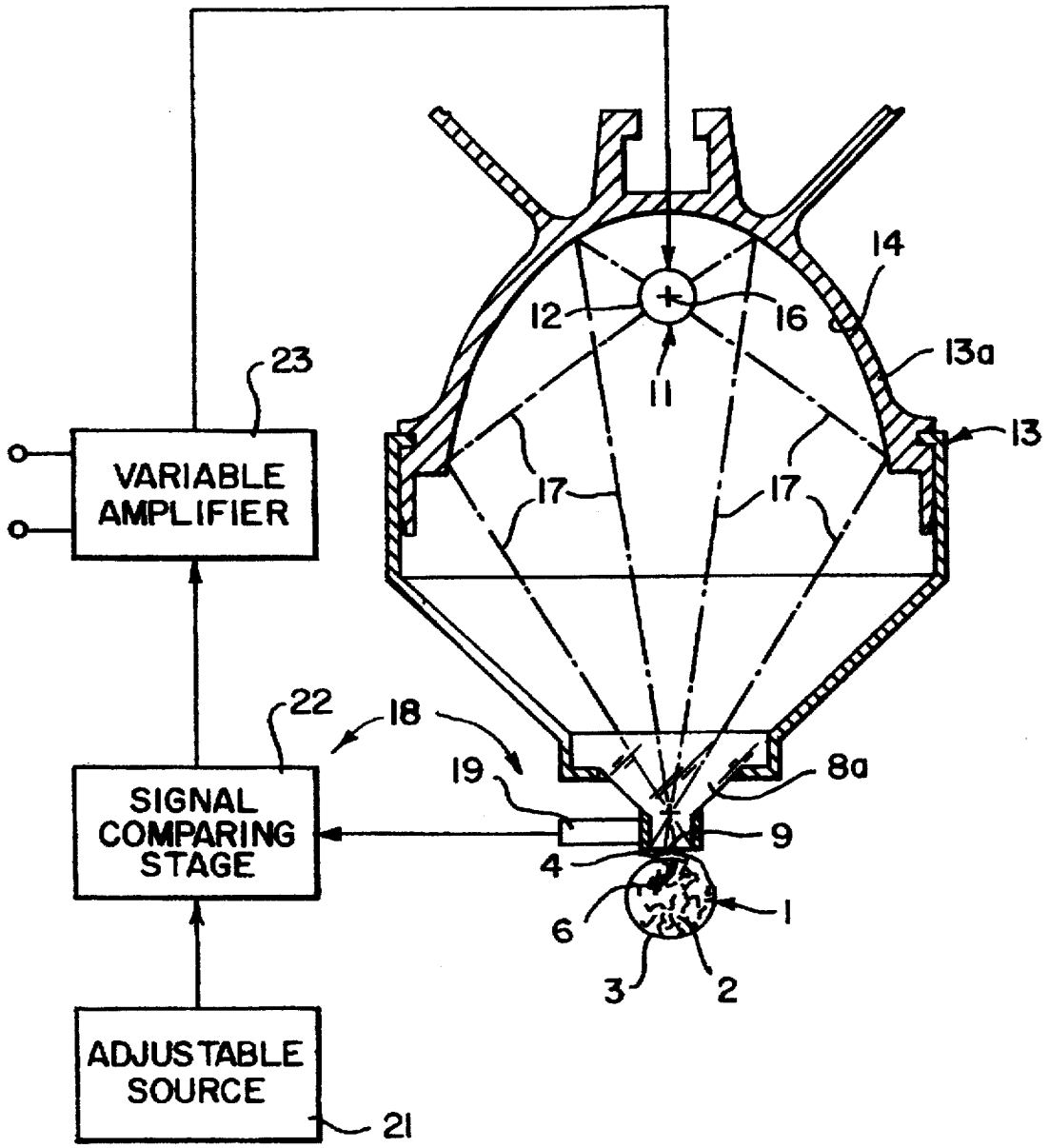
FIG. 2 is a partly diagrammatic and partly transverse sectional view of the apparatus shown in FIG. 1.

The member 8 can be replaced with a guide shown in FIG. 2 which is permeable to radiation so that the beams 17 can pass therethrough and directly heat the seam 7 while the same is being contacted by a surface of the guide, e.g., a surface corresponding to the surface 9 of the heat transfer member 8. The guide may be partially or practically fully permeable to the radiation issuing from the source 11. For example, the guide can be made of quartz glass or a suitable ceramic material. The shape of the guide can approximate or match the shape of the member 8 and the surface of the guide can contact the running seam 7 in the same way as shown for the surface 9 of the member 8. However, it is equally within the purview of the invention to employ a guide having a size and/or shape which departs from that of the member 8. If the member 8 is replaced with a radiation-permeable guide, the regulating circuit for the radiation source can employ an optical detector, probe or sensor which is designed to monitor the temperature of the wrapper 3 and/or the temperature of the seam 7.

An advantage of the aforediscussed guide is that the beams 17 of radiation issuing from the source can directly heat the seam 7 so that the thermal inertia of an apparatus embodying the invention and employing the guide is even less than that of the apparatus which is shown in the Figure. An apparatus employing the member 8 can be used for highly satisfactory heating the seams forming part of tubular wrappers for particulate tobacco or for tobacco filter material, and the same applies for apparatus employing the aforediscussed radiation-permeable guide.

If the rod 1 is formed in a machine in which the wrapper and its seam can be advanced at a plurality of different speeds, the regulating circuit 18 can be replaced with a system which varies the intensity of radiation issuing from the source 11 or an analogous source in dependency upon the fluctuation of speed of the wrapper and its seam. The temperature monitoring device 19 is then replaced with a device which transmits signals denoting the speed of the wrapper 3, and the source 21 transmits signals denoting a desired speed of the wrapper. The just described modified regulating circuit can be utilized irrespective of whether the seam 7 is heated by the surface 9 of the heat transfer member 8 or by the surface of the aforediscussed guide.

An important advantage of the improved apparatus is that the heating action upon the running seam can be altered much more rapidly than in heretofore known apparatus. Furthermore, the apparatus is simple and can be installed in existing rod making machines of the tobacco processing industry. It has been found that the overheating and charring of seams is much less likely than in machines employing conventional heating apparatus. This is attributable to the fact than the thermal inertia of the improved apparatus is much less than that of conventional apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. Apparatus for conditioning an adhesive-containing longitudinally extending seam of a tubular wrapper confining particular material of the tobacco processing industry and advancing longitudinally along an elongated path, comprising a source of radiant energy spaced apart from said path; and means for at least indirectly heating the seam in a portion of said path with radiant energy issuing from said source.

2. The apparatus of claim 1, wherein said source includes an elongated infrared radiator which is at least substantially parallel to said path.

3. The apparatus of claim 1, wherein said means for heating comprises a heat transfer member which is exposed to the radiant energy and has a surface contacting the seam in said portion of said path.

4. The apparatus of claim 3, wherein said heat transfer member contains a metallic material and is resistant to wear at least in the region of said surface thereof.

5. The apparatus of claim 1, wherein said means for heating comprises means for directly heating comprising a guide which is permeable to radiant energy and has a surface containing the seam in said portion of said path.

6. The apparatus of claim 1, wherein said means for heating comprises means for directing radiant energy from said source toward the seam in said portion of said path.

7. The apparatus of claim 6, wherein said source is disposed at a level above said path.

8. The apparatus of claim 6, wherein said means for directing radiant energy comprises at least one mirror positioned to reflect radiant energy from said source toward said portion of said path.

9. The apparatus of claim 8, wherein said at least one mirror has a substantially elliptical cross section with a focus at least close to said source.

10. The apparatus of claim 1, wherein said source is adjustable and further comprising means for monitoring the temperature at said portion of said path and means for adjusting said source as a function of departures of monitored temperature from a predetermined value.

11. The apparatus of claim 10, wherein said means for monitoring comprises means for ascertaining the temperature of said means for heating.

12. The apparatus of claim 1, wherein the wrapper and the seam are adapted to advance at a plurality of different speeds and said source is adjustable, and further comprising means for adjusting said source as a function of variations of the speed of the seam.

13. The apparatus of claim 12, wherein said adjusting means comprises a variable amplifier.

14. The apparatus of claim 1, wherein said path is at least substantially horizontal and the seam in said path faces upwardly, said source being disposed at a level above said portion of said path and said means for heating is disposed at a level between the seam in said portion of said path and said source.

15. The apparatus of claim 1, wherein said means for heating comprises a housing spacedly surrounding said source.

* * * * *